United States Patent [19]

Moscrip

[11] 4,413,473

[45] Nov. 8, 1983

[54] HEAT TRANSFER COMPONENTS FOR STIRLING-CYCLE, RECIPROCATING THERMAL MACHINES

[76] Inventor: William M. Moscrip, 309 Ellery Ct., Fredericksburg, Va. 22401

[21] Appl. No.: 403,773

[22] PCT Filed: May 14, 1982

[86] PCT No.: PCT/US82/00651

§ 371 Date: Jul. 28, 1982

§ 102(e) Date: Jul. 28, 1982

[87] PCT Pub. No.: WO82/04101

PCT Pub. Date: Nov. 25, 1982

[51] Int. Cl.[3] ..... F02G 1/04

[52] U.S. Cl. ..... 60/517

[58] Field of Search ..... 60/517, 524, 525, 526

[56] References Cited

U.S. PATENT DOCUMENTS 2,567,637 9/1951 Brey et al. ..... 60/526

4,174,616 11/1979 Nederlof et al. ..... 60/517

*Primary Examiner*—Allen M. Ostrager

*Attorney, Agent, or Firm*—W. Brown Morton, Jr.

[57] ABSTRACT

Advantageous specific applications of copper matrix composites, manganese-copper alloys, and structural ceramics to the design and construction of improved Stirling-cycle, reciprocating, thermal machines are disclosed which provide both high temperature strength and high or low thermal conductivity in components with matched thermal expansion coefficients.

4 Claims, 4 Drawing Figures

HEAT TRANSFER COMPONENTS FOR STIRLING-CYCLE, RECIPROCATING THERMAL MACHINES

TECHNICAL FIELD

This invention relates to Stirling-cycle engines, also known as regenerative thermal machines, and more particularly to the materials chosen for the design and construction of heat transfer components and their adjuncts. The desire for high thermal efficiency in Stirling engines, as in all heat engines, dictates that all heat transfer components should have the highest practicable thermal conductivity while all other components should be thermal insulators having the lowest practicable thermal conductivity.

The crux of advanced Stirling-cycle engine design is the achievement of high rates of heat transfer to and from highly pressurized working fluid; fortunately, new highstrength thermally conductive structural materials have been developed. Successful design of thermally stressed machine elements, however, requires closely matched coefficients of thermal expansion in adjacent components. The present invention provides specific new solutions to these problems and will thereby enhance the performance of all machines which embody a practical approximation to the well-known Stirling thermodynamic cycle in the production of both mechanical power (i.e. prime movers, compressors, fluid pumps) and refrigeration (i.e. refrigerators, air conditioners, heat pumps, gas liquifiers).

A Stirling-cycle engine is a machine which operates on a closed regenerative thermodynamic cycle, with periodic compression and expansion of a gaseous working fluid at different temperature levels, and where the flow is controlled by volume changes in such a way as to produce a net conversion of heat to work, or vice-versa. The regenerator is a device which in prior art takes the form of a porous mass of metal in an insulated duct. This mass takes up heat from the working fluid during one part of the cycle, temporarily stores it within the machine until a later part of the cycle, and subsequently returns it to the working fluid prior to the start of the next cycle. Thus the regenerator may be thought of an an oscillatory thermodynamic sponge, alternately absorbing and releasing heat with complete reversibility and no loss.

A reversible process for a thermodynamic system is an ideal process, which once having taken place, can be reversed without causing a change in either the system or its surroundings. Regenerative processes are reversible in that they involve reversible heat transfer and storage; their importance derives from the fact that idealized reversible heat transfer is closely approximated by the regenerators of actual machines. Thus the Stirling engine is the only practical example of a reversible heat engine which can be operated either as a prime mover or as a heat pump.

BACKGROUND

The Stirling-cycle engine was first conceived and reduced to practice in Scotland 164 years ago. A hot-air, closed cycle prime mover based on the principle was patented by the Reverend Robert Stirling in 1817 as an alternative to the explosively dangerous steam engine. Incredibly, this event occurred early in the Age of Steam, long before the invention of the internal combustion engine and several years before the first formal exposition of the Laws of Thermodynamics.

Air was the first and only working fluid in early 19th century machines, whereas hydrogen and helium have been the preferred working fluids for modern machines. In Great Britain, Europe, and the United States thousands of regenerative hot air prime movers in a variety of shapes and sizes were widely used throughout the 19th centrury. The smaller engines were reliable, reasonably efficient for their time, and most important, safe compared with contemporary reciprocating steam engines. The larger engines were less reliable, however, because they tended to overheat and often succumbed unexpectedly to premature material failure.

Toward the end of the 19th century the electric motor and the internal combustion engine were developed and began to replace not only the Stirling-cycle engines, but also the reciprocating steam engines of that era. These new machines were preferred because they could produce greater power from more compact devices and because they were more economical to manufacture. The limitations of early, as well as those of current, Stirling engines are in part directly attributable to the design and performance characteristics of the structural materials used. Both the specific power capacity and the overall thermal efficiency of regenerative thermal machines are direct consequences of the inherent performance characteristics of their heat transfer elements.

Since World War II there have been unprecedented advances in the general technologies of machine design, heat transfer, materials science, system analysis and simulation, manufacturing methods, and Stirling engine development. Today, in comparison to their conventional internal combustion counterparts, all modern Stirling-cycle prime movers are external combustion engines which consistently demonstrate (in the laboratory) higher efficiency, multifuel capability, lower exhaust emissions, quieter operation, equivalent power density, and superior torque characteristics.

Nevertheless, none of these engines is mass produced for any commercial application anywhere in the modern world. The reason for this is that contemporary Stirling engines have been developed largely by adapting traditional methods and designs from the more familiar internal combustion engine technology base. Patchwork adaptation of the old as a shortcut to the new is a process which inexorably produces a hodgepodge arrangement of excessive mechanical complexity and which inevitably results in high production costs.

The use of ordinary engine construction materials such as cast iron or aluminum alloys, for example, often results in unnecessary thermal losses and unacceptable thermal stresses between heat transfer elements and adjacent components. Prior art solutions to these problems have resulted in increased complexity and cost. Despite clearly superior technical performance characteristics, therefore, contemporary Stirling engines are invariably not cost competitive from the standpoint of economical mass production.

DISCLOSURE OF INVENTION

The invention comprises fundamental concepts and mechanical components which in combination enhance the operation yet lower the cost of Stirling-cycle machines, by virtue of the specific utilization of certain materials, namely dispersion strengthened copper composites in conjunction with manganese-copper alloys in one class of machines, and silicon carbide in conjunction with boron carbide in another class of machines, for the design and construction of heat transfer components and their adjuncts.

It is a primary object of the invention to provide a substantial increase in performance and efficiency of Stirling-cycle machines through the deliberate and judicious utilization of advanced composite materials and structural ceramics in the design and construction of heat transfer components and their adjuncts.

It is another primary object of the invention to provide an optimum selection of such materials from the standpoint of maximizing the high-temperature strength and thermal conductivity of heat transfer components, while minimizing the thermal conductivity of non-heat transfer components, yet maintaining closely matched thermal expansion coefficients between adjacent components of either class.

BRIEF DESCRIPTION OF DRAWINGS

Other objects, advantages, and novel features of the invention will become readily apparent upon consideration of the following detailed description when read in conjunction with the accompanying drawings wherein:

FIG. 2(*c*) is a pressure-volume diagram which depicts the working of an actual machine;

Best Mode for Carrying Out Invention

Figure 1:
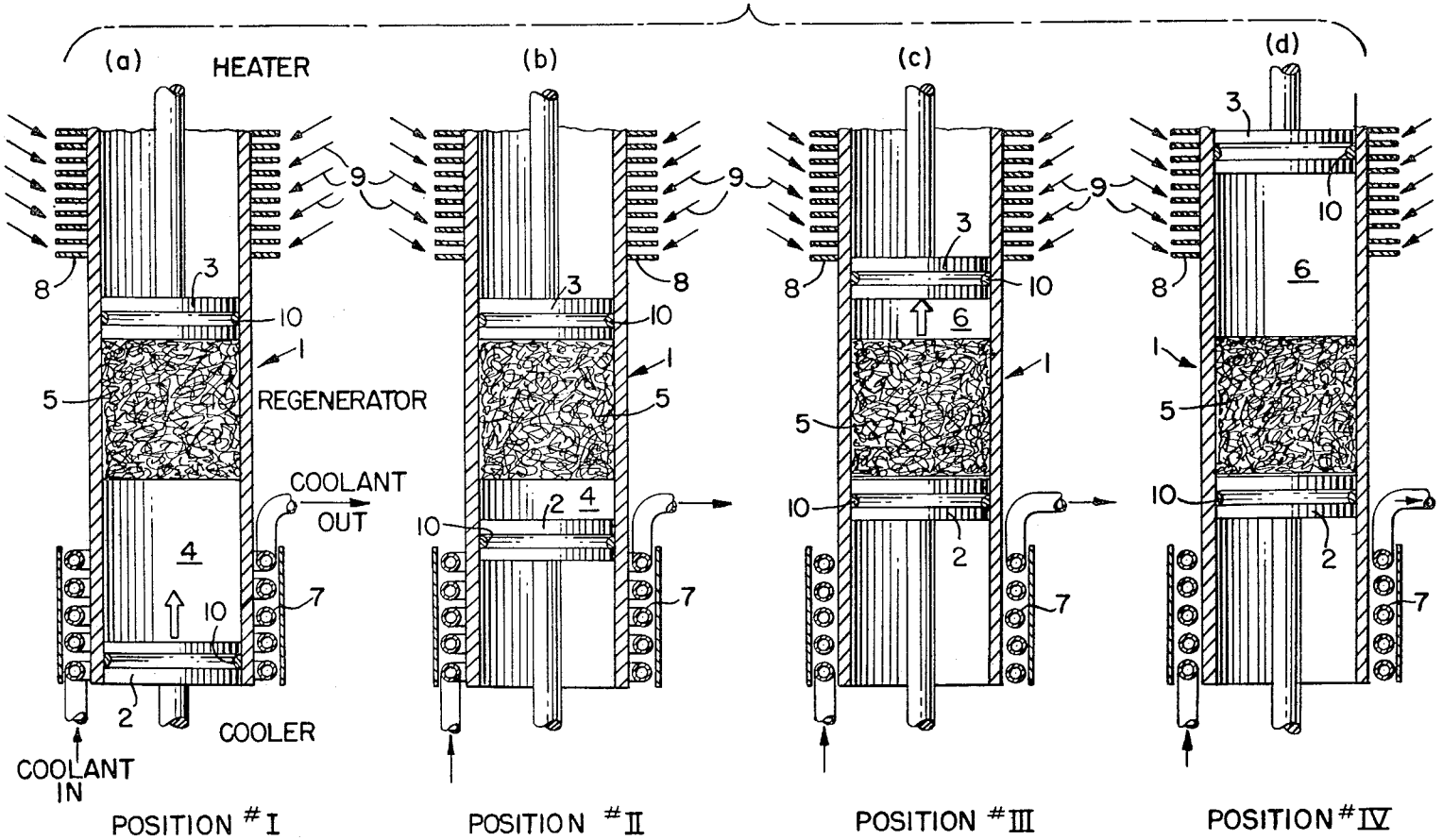
FIG. 1 is an illustration of the operational sequence of events during one complete cycle of an idealized singleacting two-piston Stirling engine used in the prime mover mode.

Attention is directed to FIG. 1 wherein numeral 1 designates an idealized version of a two-piston Stirling-cycle prime mover. A conceptually constant mass of pressurized gaseous working fluid occupies the working volume between the compression piston 2 and the expansion piston 3. The total working volume is comprised by compression space 4, regenerator 5, and expansion space 6. A portion of compression space 4 is continually cooled by cooler 7, while a portion of expansion space 6 is continually heated by heater 8. Arrows 9 are intended to represent the input of heat by conduction, convection, or radiation. Escape of fluid from the working volume is prevented by the piston seals 10.

During the compression stroke (between position I and II) the working fluid is compressed isothermally by piston 2 at the minimum temperature level of the cycle. Heat is continually rejected at this temperature through cooler 7; the pressure rises slightly and the total working volume decreases to a minimum. During the forward displacement (cold-side to hot-side transfer) stroke (between positions II and III) regenerator 5 yields stored heat to the working fluid as it is transferred to expansion space 6 with the volume remaining constant. The temperature and pressure rise to their maximum levels.

During the expansion stroke (between positions III and IV) the working fluid expands isothermally at the maximum temperature level of the cycle, doing work on piston 3. The temperature level is maintained by the input of heater 8; the pressure drops and the total working volume increases to a maximum. During the reverse displacement (hot-side to cold-side transfer) stroke (between positions IV and I) regenerator 5 recovers heat from the working fluid as it is transferred to compression space 4 with the volume remaining constant. The temperature and pressure return to the starting levels of the cycle.

Figure 2:
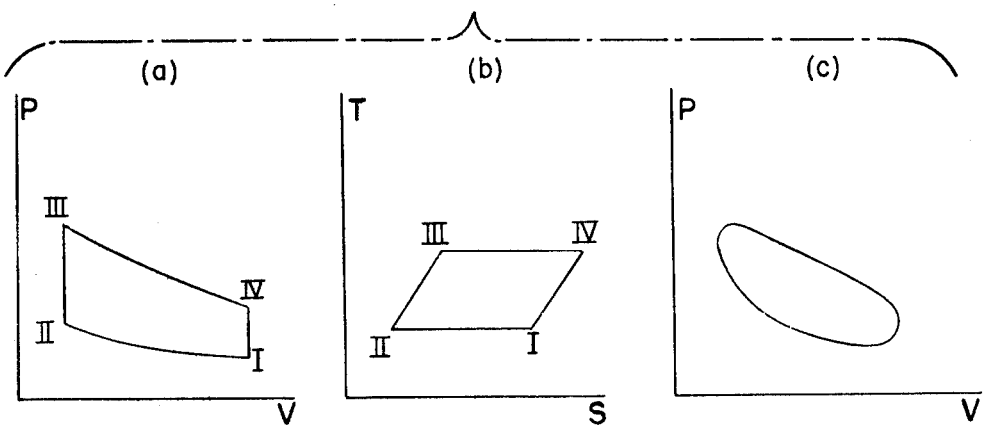
FIG. 2(*a*) and FIG. 2(*b*) are schematics which illustrate the idealized pressure-volume and temperature-entropy diagrams of the thermodynamic cycle of the working fluid in the same machine depicted by FIG. 1.

A clearer understanding of the foregoing may be obtained by referring to the diagrams of FIG. 2(*a*) and FIG. 2(*b*) wherein the same complete cycle is presented in terms of the pressure-volume diagram and the temperature-entropy diagram for the working fluid. For each process as depicted by the curves between the indicated position numbers I-II, II-III, III-IV, and IV-I, the area under a curve on the P-V diagram is a representative measure of the mechanical work added to or removed from the system during the process. Similarly, the area under a curve on a T-S diagram is a measure of the heat transferred to or rejected from the working fluid during the process.

Actual machines differ fundamentally from the idealized versions in that the motion of each piston is continuous and smooth, rather than discontinuous and abrupt. This causes the indicated processes of FIG. 2(*a*) and FIG. 2(*b*) to overlap one another, and results in P-V diagrams which are smooth continuous curves devoid of sharp corners as shown by FIG. 2(*c*). Thus the piston motion of actual machines is smoothly periodic to the point of being sinusoidal, and the working fluid is likewise distributed in a periodically time-variant manner throughout the total working volume.

The preferred embodiments of the present invention involve the specific application of certain recent advances in the field of materials technology to improved Stirling-cycle machine design. A classic problem associated with the design of any thermal machine or heat engine, which must by definition accommodate interior regions at different temperature levels, arises from the characteristic behavior of materials at elevated temperatures. The ramifications of this problem are perhaps most often encountered in the form of these two serious and inevitable physical effects: heat rupture and differential expansion.

It is well known that the strength, hardness, creep resistance, and other mechanical properties of all engineering materials, with the exception of graphite and other forms of carbon, diminish with increasing temperature. Thus all material structures possess a maximum use temperature. It is also well known that a fixed joint between components which have different linear thermal expansion coefficients generally produce undesirable and potentially destructive thermal stresses in a structure undergoing a large temperature change. Therefore the intelligent design of thermal machines demands the selection of those materials which possess the requisite use temperature, but which also exhibit closely matched thermal expansion properties with respect to other materials placed in adjoining proximity.

Figure 3:
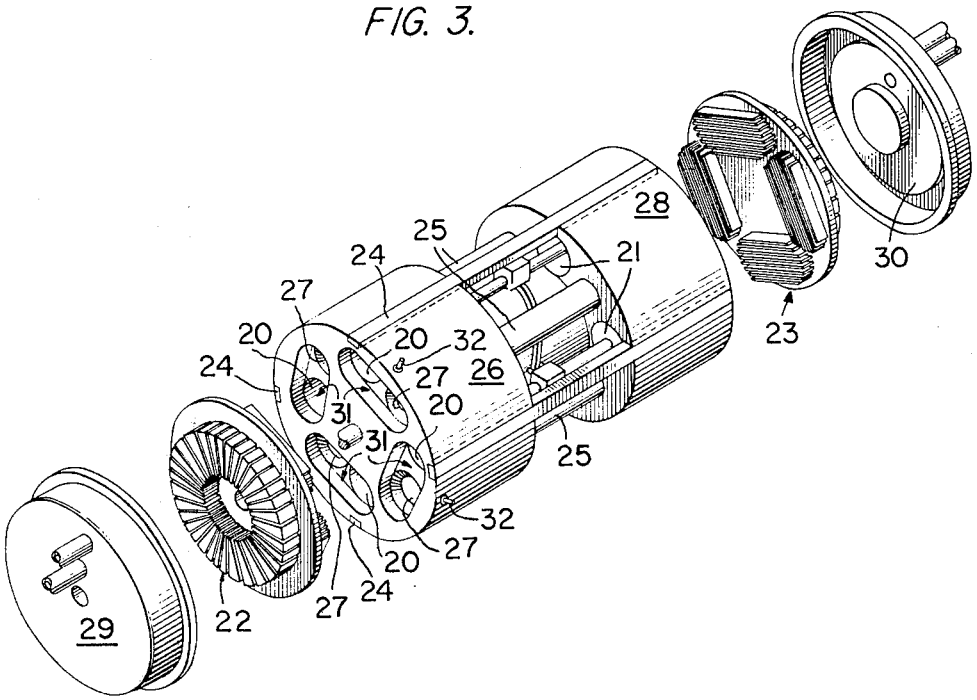
FIG. 3 is a partially exploded perspective view which illustrates the component arrangement of an exemplary multistage, single-acting, quasi double-acting Stirling engine known as a drum cam machine.

A good illustration of the foregoing may be examined by referring to FIG. 3 in which the component arrangement of a specific single-acting, multiple-piston, Stirling engine of my invention (denominated by me as a "drum cam" machine) appears. It should be apparent that all compression spaces 20 are collocated within a single stationary right-circular cylindrical "compression block" 26 made of material having comparatively low thermal conductivity.

Likewise all expansion spaces 21 are collocated within a single stationary right-circular cylindrical "expansion block" 28, also made of material having comparatively low thermal conductivity. Compression block 26 and expansion block 28 are conjoined by the four regenerator housings 25 and also by the four longitudinal cams 24. At the extreme opposite ends of each of both compression block 26 and expansion block 28, a series of shallow segmented annular depressions 31 connect each piston-cylinder working volume with an adjacent regenerator duct 27 and serve as a housing for the internal heat transfer surfaces of either cooler 22 or heater 23. Working fluid is conveyed into each piston-cylinder working volume by means of tank valves 32 located on the periphery of compression block 26.

Thus it may be seen that the individual heat exchange elements of each of the aforedescribed separate but interconnected working volumes are naturally and conveniently collocated within a single component, cooler 22 or heater 23. These now consist of a flanged plate made of material possessing comparatively high thermal conductivity, each having a plurality of radial flow passages on the exterior face and plurality of segmented annular flow passages on the interior face. Cooler 22 serves upon assembly and in conjunction with cooler head 29 to close and connect compression volumes 20 with adjacent regenerators 27 and to transfer heat from the internal working fluid to an exterior sink. Heater 23 serves upon assembly and in conjunction with heater head 30 to close and connect expansion volumes 21 with adjacent regenerators 27, and to transfer heat from an exterior source to the internal working fluid.

The drum cam machine design is an arrangement which involves a minimum number of separate components, and wherein the hot and cold regions of the machine are inherently located at extreme diametrically opposite ends. It should be readily apparent to those skilled in the art that the collocation of cooler elements within a compact cooler head at one end of the drum cam machine, and of heater elements within a similarly compact heater head at the other end of the machine, has the highly desirable effect of reducing heat losses from conduction and radiation to improve the overall thermal efficiency of the machine. But it also leads to a substantial simplification in the design and manufacture of not only the heat transfer elements but also of other mechanical components of the machine as well.

In this regard, the materials chosen for the design of the heat transfer components and of the heater head components in a Stirling prime mover present the greatest challenge. These should ideally possess either high or low thermal conductivity and high strength at a nominal use temperature of at least 750° C. (1382° F.) as well as a closely matched thermal expansion coefficient compared to that of any adjacent component or components. Pure copper has the most desirable thermal conductivity of any of the common engineering materials, but its notorious loss of strength and creep resistance at high temperatures precludes its use in such applications. Certain copper alloys have improved high temperature mechanical properties, beryllium copper for example, but their corresponding thermal properties are typically no better than those of high temperature steels, which are stronger and often less expensive.

It is an important specific teaching of this invention, therefore, to use a new materials technology development of the type exemplified by a product of the Glidden Metals Division of SCM Corporation known as GLIDCOP. GLIDCOP is a dispersion strengthened copper composite material offering both high temperature strength and high thermal conductivity. It consists of a high purity copper with submicroscopic particles of insoluble aluminum oxide finely distributed throughout the copper matrix. Dispersion strengthening offers one of the most promising methods of improving the elevated temperature properties of copper without seriously degrading its thermal conductivity.

Figure 4:
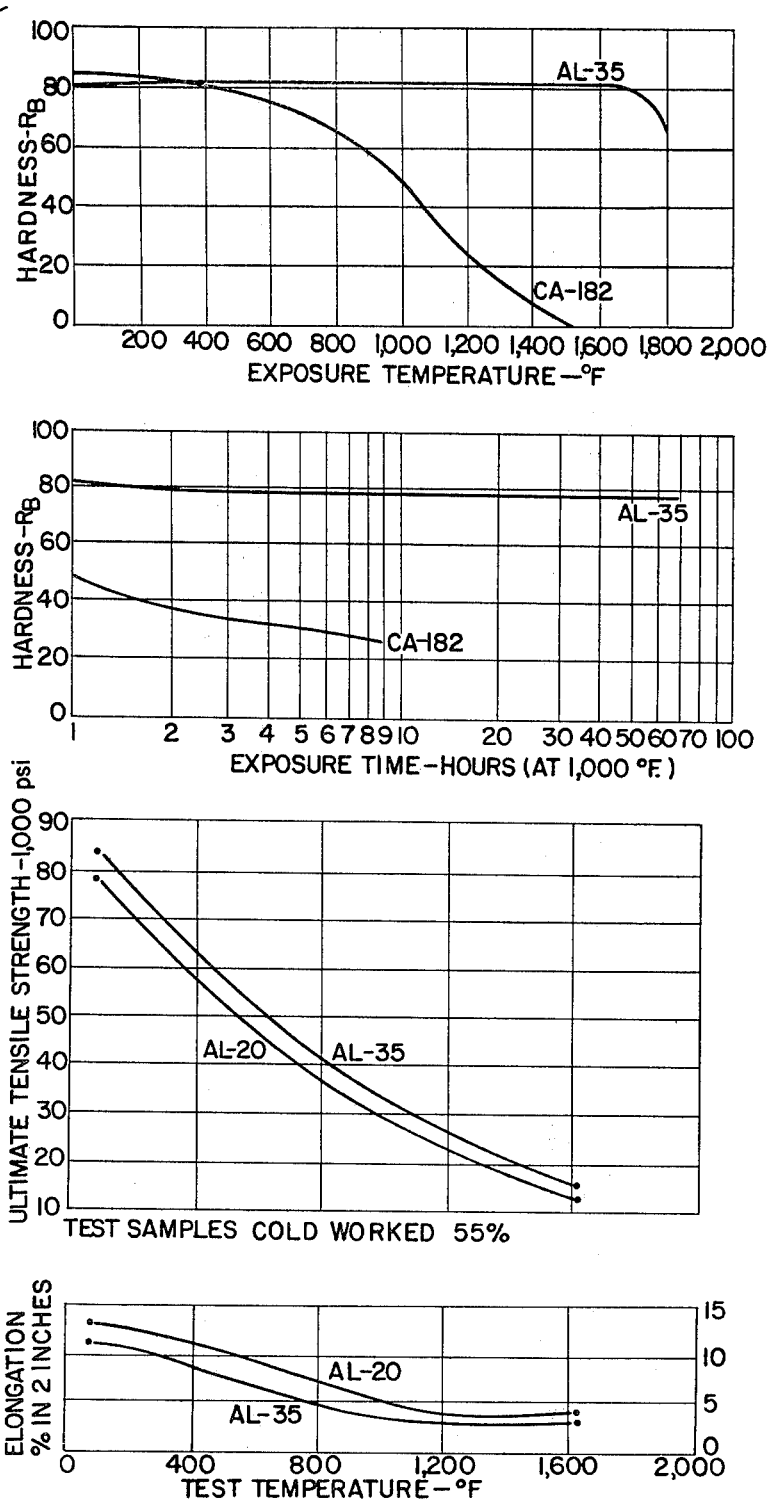
FIG. 4 depicts some of the unique elevated temperature mechanical properties of GLIDCOP dispersion strengthened copper composite.

The strengthening mechanism in GLIDCOP is a finely dispersed phase that acts as a barrier to dislocation movement in the composite material. In GLIDCOP and other materials of similar nature, but different origin, the dispersed phase remains insoluble in the copper matrix, and hence no overaging in the usual sense can occur at elevated temperatures as it does in heat treatable alloys. The dispersed phase particles interfere with dislocation movement, raise the recrystallization temperature, and exert a powerful effect on elevated temperature strength and hardness. The graphs of FIG. 4 illustrate some of the unique elevated temperature mechanical properties of GLIDCOP. The terms AL-20 and AL-35 refer to materials having 0.20 and 0.35 weight percent aluminum present as oxide, while the term CA-182 refers to a standard and well-known high temperature copper alloy.

It is appropriate at this point to re-emphasize that the material for the insulative components of the heater head and the expansion block of a Stirling engine should have, in conjunction with the adjacent heater, a closely matched thermal expansion coefficient and the lowest possible thermal conductivity. It is therefore, another important specific teaching of this invention that the use of eutectic or near-eutectic manganese-copper alloys can satisfy both of these requirements and provide a high degree of vibration damping capacity as well. That is, referring back to FIG. 3 for example, it is proposed that heater 23 should be made of GLIDCOP, whereas both expansion block 28 and heater head 30 should be made of manganese-copper eutectic alloy to achieve maximum utility with minimum thermal stress or strain.

Since the Stirling-cycle engine, according to the Carnot principle and the well-known laws of thermodynamics, achieves maximum efficiency by virtue of a large difference in temperature between the expansion volume and the compression volume, there is a strong incentive to raise the normal operating temperatures of the heater head and expansion block components in prime movers beyond the normal limits of ordinary materials. Recent advances in the research and development of high temperature structural ceramics promise to greatly extend the performance limitations of current Stirling-cycle prime movers. It is well known, for example, that hot-pressed and reaction-bonded silicon carbide, silicon nitride, and the oxygen-substituted silicon nitride compounds called SIALONS retain high strength at temperatures as high as 1400° C. (2552° F.).

Advanced structural ceramics are also attractive choices because of their low density, high strength-to-weight ratio, low cost compared to the superalloys, and excellent hot gas corrosion resistance. But the promise of these materials will be ultimately realized only for conceptual designs which retain sufficient component level simplicity to allow economical mass production—an absolutely essential prerequisite for success in the market. The advantages inherent in the various embodiments of this invention may permit, for the first time in history, the mass production of competitive introduction of a ceramic-enhanced Stirling-cycle engine into world markets.

In this regard, it is yet another important specific teaching of this invention that an ideal combination of both mechanical and thermal properties is to be found in the use of silicon carbide (SiC) for the heat conducting components in conjunction with boron carbide ($B_4C$) for the heat insulating components of an advanced ceramic-enhanced Stirling-cycle prime mover. The coefficient of linear thermal expansion (from 0°–1000° C.) for these materials is very closely matched ($4.5\times 10$exp-6 cm/cm/°C.), while the ratio of their thermal conductivities is nearly 80 to 1. Boron carbide is also an excellent choice for piston and cylinder construction because of its low density and extreme hardness; it is well known to resist abrasive wear better than any other readily available engineering material.

Since the closed cycle Stirling prime mover operates solely on the basis of the difference in temperature in the working fluid between the hot expansion space and the cold compression space, the development of useful power output is not specific to the source of heat available for use. Therefore, the design of the heat source can be any one of a large variety of possible types. A rather simple combustion system can be produced, for example, which will cleanly and efficiently burn various kinds of both liquid fuels and gaseous fuels without any modification whatsoever. Thus it will be appreciated by those familiar with the art that a single prime mover may be made to operate on regular or premium gasoline, diesel oil, alcohol, crude oil, lubricating oil, vegetable oil, propane, butane, natural gas, and synthetic coal gas.

It should also be appreciated that through the intermediary of a suitable heat transport system, a heat pipe exchange unit for example, virtually any heat source at a sufficiently high temperature can be adapted, including radioisotopes, nuclear reactors, solar collectors, thermal storage devices, and the burning of coal, wood, or even municipal solid waste. The heat pipe is a well-known device for passive heat transfer in which a fluid within a sealed envelope vaporizes when heated and condenses when cooled, transferring heat by vapor transport before being returned to the heat source as liquid again, generally by capillary action. The historical development, theory of operation, and details of construction of the heat pipe are amply set forth in U.S. Pat. Nos. 2,350,348 and 3,229,759.

The heat pipe is an amazingly simple device with no moving parts, and it can transfer large quantities of heat between small temperature differences. Its effective thermal conductivity is hundreds of times better than that of any solid conductor, including copper, for the same volume. It is yet another important specific teaching of this invention, therefore, that the use of heat pipes in the design of both the heater exchange elements and the cooler exchange elements is indicated for very high performance Stirling-cycle machines. Referring again to FIG. 3, for example, heaters 23 and coolers 22 could be substantially hollow instead of solid structures containing both working fluid and wick common to the heat pipe for improved heat transfer.

It is important at this point to re-emphasize the fact that each small segment of a well-designed regenerator transfers heat to and from the working fluid with minimal temperature differences. Thus all stages in the regenerator are reversible in an actual thermodynamic sense. Therefore, the entire machine cycle is reversible in function; that is, the direction of flow of heat and work can be reversed. The Stirling engine is truly unique in that it is the only practical example of a thermodynamically reversible machine.

It should be thoroughly understood, therefore, that many of the design concepts disclosed herein for Stirling prime movers are also applicable to the design and development of Stirling refrigerators, heat pumps, air conditioners, and the like. It is another important specific teaching of this invention that machines of this kind would be appreciably more efficient than conventional vapor cycle reciprocating refrigerators or thermally-activated absorption refrigerators, with a substantial savings in size and weight. In addition, a hybrid device obtained from the combination of a Stirling prime mover mechanically coupled to a Stirling heat pump will permit both multifuel and nonfuel powered refrigeration units to be developed and applied to specialized applications.

In view of the foregoing it should be readily apparent to those skilled in the art that the operation of the present invention may be accomplished by means of and in the context of an enormous variety of diverse applications. In fact, virtually every market in the world which is currently occupied by the application of a reciprocating internal combustion prime mover, or by the application of a conventional vapor cycle, absorption, or other type of refrigeration device, is subject to improvement by virtue of the diligent application of the teachings of this invention.

These include but are by no means limited to the following: automotive prime movers, marine prime movers, aeronautical prime movers, industrial prime movers, military prime movers, agricultural prime movers, multifuel prime movers, nonfuel prime movers, portable prime movers, biomedical prime movers, refrigerators, air conditioners, cryogenic cooling engines, residential heat pumps, industrial heat pumps, military heat pumps, water coolers, air compressors, other gas compressors, remote electric generators, portable electric generators, stationary electric generators, hydroelectric power converters, nuclear power converters, radioisotope power converters, solar power converters, geothermal power converters, ocean thermal power converters, biomass power converters, solid waste power converters, small cogeneration power plants, large cogeneration power plants, remote fluid pumps, portable fluid pumps, stationary fluid pumps, remote power tools, portable power tools, outdoor power tools, underwater power tools, toys and novelties.

Obviously, many modifications and variations of the present invention may occur to those skilled in the art in the light of the above teachings. Indeed, every potential application of a Stirling-cycle engine which may be accomplished by machines operating on the principles set forth herein is, in and of itself, a unique and special variation of this invention. It is therefore to be understood that within the scope of the appended claims the invention may be practiced otherwise than as specifically described.

I claim:

1. A Stirling-cycle, reciprocating, thermal machine having an expansion space, a compression space, a regenerator, a working fluid enclosed in said spaces and in ducts permitting oscillatory flow of said fluid between said spaces through said regenerator, a heater for transmitting heat from an external heat source to working fluid in the expansion space, a cooler for transmitting heat from working fluid in the compression space to an external heat sink, the heat transfer element of at least said heater being constructed of a material having high thermal conductivity and being affixed to said machine by joining structure having low thermal conductivity, said transfer element and said joining structure having substantially the same linear thermal expansion coefficients.

2. A machine according to claim 1 in which the heat transfer element is constructed of dispersion strengthened copper and the joining structure is of manganese-copper eutectic or near-eutectic alloy.

3. A machine according to claim 1 in which the heat transfer element is constructed of silicon carbide ceramic and the joining structure is of boron carbide ceramic.

4. A machine according to claim 1 in which the heat transfer element is constructed in the form of one or more heat pipes collocated at the remote ends of the machine, said heat pipes being designed and arranged to provide a passage therethrough with the highest practicable ratio of exposed surface area to cross-sectional flow area.

* * * * *